United States Patent [19]

Schubert et al.

[11] Patent Number: 4,568,243

[45] Date of Patent: Feb. 4, 1986

[54] VIBRATION ISOLATING SEAL FOR MOUNTING FANS AND BLOWERS

[75] Inventors: Dale W. Schubert, Sudbury; Richard S. Gureghian, Burlington, both of Mass.

[73] Assignee: Barry Wright Corporation, Newton, Mass.

[21] Appl. No.: 612,152

[22] Filed: May 21, 1984

Related U.S. Application Data

[63] Continuation of Ser. No. 309,747, Oct. 8, 1981, abandoned.

[51] Int. Cl.[4] ..... F04D 29/52; F24F 7/13

[52] U.S. Cl. ..... 415/213 C; 415/119; 415/219 R; 248/638; 248/570

[58] Field of Search ..... 415/119, 213 C, 219 R, 415/170 R; 98/39, 43 R; 248/548, 549, 560, 570, 585–587, 589, 609, 603–606, 610, 632, 638, 679; 277/3, 12, 97, 133, 134, 228, 212 R, 212 FB, 212 F; 123/41.49, 41.63

[56] References Cited

U.S. PATENT DOCUMENTS

| | | | |
|---|---|---|---|
| 2,650,021 | 8/1953 | Morrill | 415/219 R |
| 2,936,141 | 5/1960 | Rapata | 248/604 |
| 3,144,859 | 8/1964 | Walton | 415/219 R X |
| 3,161,388 | 12/1964 | Appleton | 248/603 |
| 3,244,105 | 4/1966 | La Flame | 415/143 |
| 3,310,698 | 3/1967 | Krell | 98/39 |
| 3,976,393 | 8/1976 | Larson | 415/219 R |
| 4,116,171 | 9/1978 | Schulmeister et al. | 123/41.49 |
| 4,120,271 | 10/1978 | Edmaier | 123/41.49 |
| 4,213,426 | 7/1980 | Longhouse | 415/213 C X |

FOREIGN PATENT DOCUMENTS

| | | |
|---|---|---|
| 522231 | 6/1940 | United Kingdom . |
| 674280 | 6/1952 | United Kingdom . |
| 883686 | 12/1961 | United Kingdom . |
| 897978 | 6/1962 | United Kingdom . |
| 898002 | 6/1962 | United Kingdom . |

OTHER PUBLICATIONS

*Application Selection Guide,* Barry Noise and Vibration Control, 1977.

*Primary Examiner*—Robert E. Garrett
*Assistant Examiner*—Joseph M. Pitko
*Attorney, Agent, or Firm*—Milton E. Gilbert; Gary E. Ross

[57] ABSTRACT

A vibration isolating and sealing device for mounting a fan having a propeller rotatably secured within a housing, said device comprising an outer, substantially square frame; an inner substantially square frame; a generally "S" shaped flexural membrane disposed between and connecting said inner to said outer frame; said membrane being made of elastomer, and wherein the inner frame has a central bore configured to channel air to the propeller of the fan.

19 Claims, 6 Drawing Figures

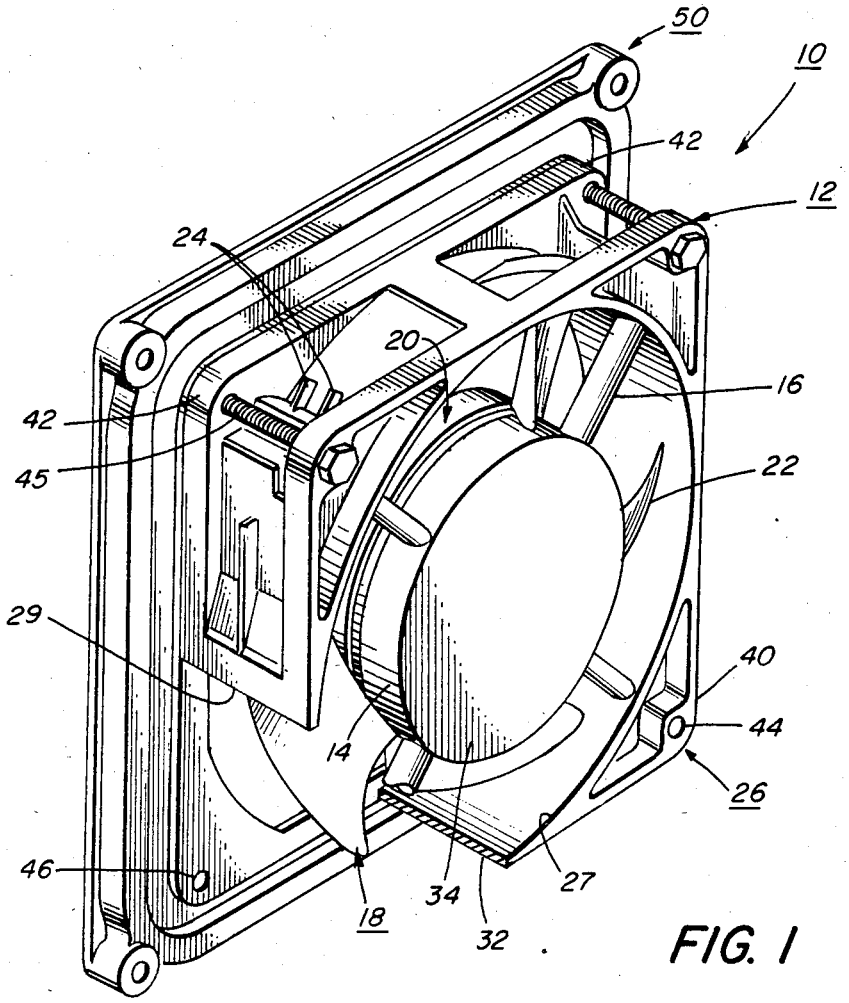
FIG. 1
FIG. 5
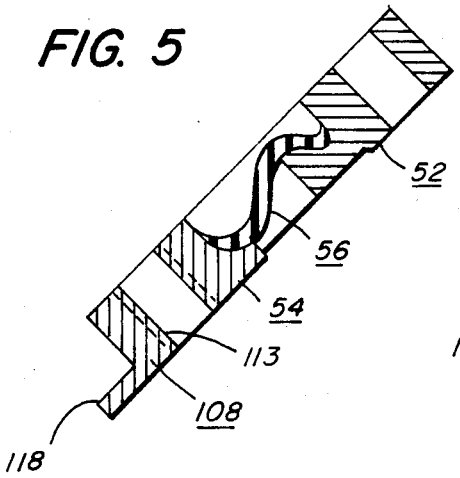
FIG. 6
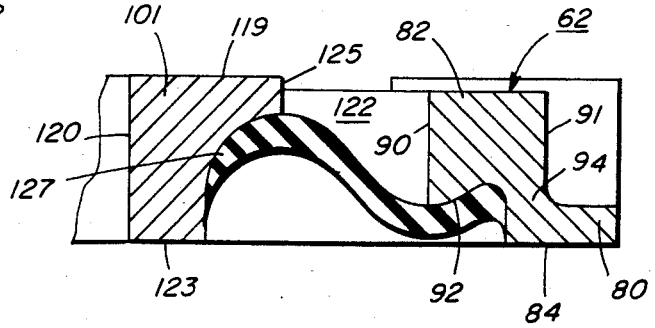

VIBRATION ISOLATING SEAL FOR MOUNTING FANS AND BLOWERS

This application is a continuation of application Ser. No. 309,747, filed 10/8/81, now abandoned.

This invention relates to fans and blowers, and more particularly to a vibration-isolating and sealing device for mounting same to, for example, metallic cabinets and enclosures housing operating electronic devices.

As is well known to one in the art, electrical components and devices, by their operation, generate heat and are, by their nature, susceptible to damage by the elevated temperatures. Frequently, specific devices are provided with heat sinks, such as heat-conductive fins, to remove the unwanted heat from the device by radiation, conduction and convection to the environment.

Space limitations and the drive towards miniaturization have resulted in smaller space allowances for electronic components used in, for example, data processing equipment and peripherals, especially desk top units. The electronic equipment is typically packaged in a cabinet or enclosure which protects the devices but frequently provides minimal room within for convection cooling. To provide air circulation the cabinets are provided with fans which are, all too often, fastened directly to the cabinets, an arrangement known as "hard mounting". The fans are generally known as "muffin fans" and typically comprise a propeller rotatably mounted within a frame on a hub containing the prime mover. In the four corners of the frame are disposed holes for receiving bolts which secure the fan to a panel of the cabinet.

Hard-mounting can result in the vibrational excitation of the cabinet at the one-per-revolution and blade-pass frequencies, and their respective harmonics, of the fan during operation as well as the power line frequency and its harmonics. This structure-borne component of noise can be most undesirable for particular locations, such as when the electronic cabinets are within an office, and especially when several such fans are operating.

To reduce the structure-borne noise, various mounting arrangements have been suggested. One such scheme involves the use of cylindrical isolators, one disposed axially about each bolt between the fan and the cabinet panel. Unfortunately, without redesign of the cabinet, this mounting arrangement results in a gap between the fan and the panel. The gap provides a secondary path for air pushed or drawn by the fan and thus would reduce the effectiveness of the fan in dissipating heat from within the cabinet. Further, in arrangements in which fans blow air, ofter filtered, into the cabinet to maintain positive pressure, such a gap would hinder pressure build-up.

To fill the gap an annular foam insert has been used as a seal to channel the moving air and prevent its escape through the gap. This arrangement can be cumbersome and expensive, both in manufacture, repair and assembly.

Another disadvantage with the prior art just described is its profile. Since the fans are frequently mounted within the cabinet, minimal space consumption is desirable. The profile or stand-off height (measured from the cabinet panel on which the fan is mounted to the opposite side of the fan) should preferably be as small as possible. With the cylindrical isolators disposed about each bolt, the fan may have a most undesirable profile.

Accordingly an object of the present invention is to provide a vibration-isolating and mounting arrangement for fans and blowers.

Another object of the present invention is to provide a seal disposable between a device such as a fan or blower and a surface on which the device is mounted.

A further object of the invention is to provide a vibration-isolating and sealing means for mounting fans, blowers and the like and preventing the transmission of structure-borne noise.

A still further object of the invention is to provide a vibration-isolating and sealing means having a reduced profile or stand-off height.

Yet another object of the present invention is to provide a vibration-isolating and sealing means which is of simple design and can be economically manufactured and assembled.

These and the other objects are met in the present invention in which is provided a vibration-isolating and sealing means for mounting a fan having a propeller, said means comprising an outer, substantially-square frame; an inner, substantially square frame disposed coaxially and radially within the outer frame; a generally "S" shaped flexural membrane disposed between and connecting said inner to said outer frame; said membrane being made of elastomer and said inner and outer frames being made of a plastic or elastomer material; means for flush mounting the fan on the inner frame, means for flush mounting the outer frame on a support surface, and wherein the inner frame has a central bore configured to channel air to the propeller of the fan. In another embodiment of the invention the vibration-isolating seal is made integrally with the housing of the fan. The mount, or mount and housing unit, can be manufactured, for example, by the process described in the Patent Application Ser. No. 198,792, now U.S. Pat. No. 4,385,025, filed on Oct. 20, 1980 and commonly assigned.

BRIEF DESCRIPTION OF THE DRAWINGS

For a fuller understanding of the nature and objects of the present invention, reference should be had to the following detailed description taken in connection with the accompanying drawings in which like reference numerals designate like features, and wherein:

FIG. 1 is a perspective view of a fan including a fan housing incorporating a vibration-isolating seal made in accordance with the present invention;

FIG. 5 is a sectional view taken along line V—V of FIG. 2; and

FIG. 6 is a sectional view taken along line VI—VI of FIG. 4.

Referring to FIG. 1, a fan 10 is shown as comprising a housing 12, a hub 14 fixedly connected to the housing by ribs 16, and a propeller 18, a term used in its broadest sense to include impellers, comprising an annular portion 20, and a plurality of circumferentially-spaced blades 22 radiating from and connected to the annular portion, said annular portion being rotatably mounted on said hub. In the version of the fan 10 shown, hub 14 includes therein a prime mover (not shown) such as a small electrical motor energized through leads 24. The fan housing 12 includes a first flange element 26, a second flange element 28 in spaced parallel relation to the first flange element, and a cylindrical body 30 therebetween. The flange elements 26 and 28 have central openings 27 and 29, respectively. The cylindrical body 30 has a central circular opening 32 extending axially therethrough and in axial alignment with and of a diameter approximately equal to the openings 27 and 29. Opening 32 is further sized so as to have an axial extent greater than that of the blades 22 and a diameter sufficient to permit the unemcumbered rotation of the propeller 18. Preferably the diameter of the opening 32 is minimized and yet is sufficient to permit a clearance fit of the propeller 18 therein. Thus the opening 32 effectively channels air pushed or drawn by the propeller 18. The annular portion 20, for example, is disposed concentrically about the hub 14 over a portion of its axial extent, and the ribs 16 are peripherally-spaced and connected to the remaining axial extent of the hub proximate its planar end 34 closest to the first flange element 26.

Figure 2:
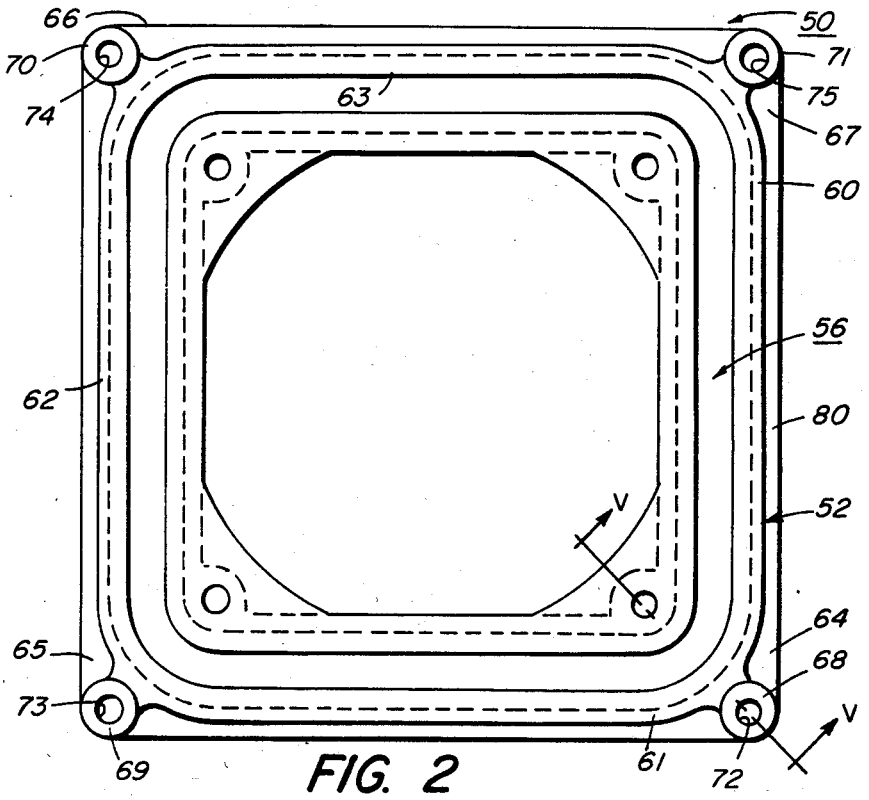
FIG. 2 is a top plan view of a vibration-isolating and sealing mount constructed in accordance with an embodiment of the invention.
Figure 3:
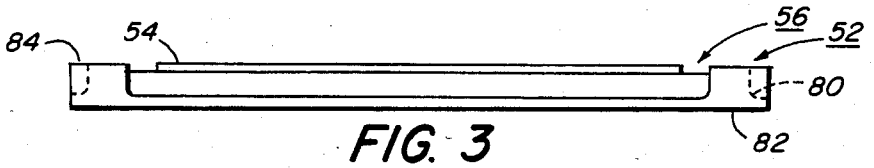
FIG. 3 is a side view in elevation of the vibration-isolating and sealing mount shown in FIG. 2.

Preferably the flange elements 26 and 28 are of a square geometry, extending radially beyond the body 30 at their corners, designated 40 and 42 respectively. Each of the corners 40 and corners 42 can be provided with one of the axially-directed holes 44 and 46, respectively sized to accommodate therethrough bolts 45. The outer diameter of the body 30 is equal to the length of a side of the square-shaped flange elements. Thus the overall size of the housing 12 as just described is minimized.

Also illustrated in FIG. 1 is a device 50, made in accordance with the invention, which acts as a vibration-isolating seal, shroud and mount. As shown, the housing 12 is fastened to the device 50 by bolts 45. In lieu of this arrangement other means for fastening, such as adhesive or tongue-and-slot are within the purview of the invention. Or, for example, the housing can be integrally formed with the device 50. This shall be more fully described following the detailed description of device 50 below.

FIGS. 2, 3, 4 and 5 illustrate the device 50, which comprises an outer, substantially square frame 52; an inner, substantially square frame 54 disposed coaxially and radially within the outer frame; and a generally "S" shaped flexural membrane 56 disposed between and connecting said inner to said outer frame, and for example, structurally bonded therebetween. The shape of the membrane 56 provides improved bond strength to the outer and inner frames 52 and 54, respectively, by increasing bond area. Further, the shape is dictated by operational requirements, namely, the shown configuration achieves approximately equal translational and coaxial stiffness and lower radial stiffness than a flat element would and thereby provides stable low-stiffness support of the fan 10 (FIG. 1). For example, the membrane 56 is made of elastomer and said inner and outer frames 52 and 54 are made of a substantially rigid or non-extensible material, for example, metal, polymer (plastic), an elastomer material more rigid (higher shear and Young's moduli) than said membrane material or a polymer metal composite. The membrane 56 both supports the static and dynamic loads and provides a pathbreak for structure-borne noise and vibration. The term "elastomer" is used herein in its broader meaning to include various elastic substances which are rubber or rubber-like. The term, for example, embraces polymers which are cross-linked to become rubber-like and are thermoset-vulcanized, as well as thermoplastic copolymer compounded materials. The flexural membrane, for example, has a static shear modulus in the range of 100 pounds per square inch and a Young's modulus for compression in the range of three times the shear modulus; hence the magnitude of Posion's ratio is 0.5. In effect the membrane 56 can be termed "visco-elastic", i.e., it has a broad yield range on its associated stress/-strain curve and a "memory" so that it returns to its original shape after removal of applied forces. Its viscous nature provides its inherent hysteretic properties which result in dynamic energy loss or vibrational damping. The inner and outer frames 52 and 54 respectively, should be made substantially rigid though sufficiently deformable to achieve "sealing" between the outer frame 52 and a support surface (not shown) and the inner frame 54 and the fan 10 (FIG. 1) despite surface irregularities.

The outer frame 52, as shown in FIG. 2, comprises four elongate elements 60, 61, 62, 63 of equal length, each one connected orthogonally at its ends to another of the elements so as to form a square. Preferably the elements 60, 61, 62, 63 are molded integrally. The corners 64, 65, 66 and 67 between abutting ends of the elements 60–63, respectively, are each provided with bulbous projections 68, 69, 70, 71, respectively, extending radially outward. Axially directed holes 72, 73, 74, 75 extend through the projections 68–71, respectively, and are sized and spaced to receive bolts or screws (not shown) therethrough, which fasten the device 50 to a support surface, for example, a panel of an electrical equipment cabinet (not shown). A strengthening flat 80 is disposed about the periphery of the outer frame 52. The cross-sectional shape of elements 60–63 can be gleaned from FIG. 6 which is a representative example. This figure is a sectional view taken along line VI—VI of FIG. 4 which is the bottom plan view. The element 62 is shown in cross-section as having a planar bottom surface 82 with two orthogonally depending side walls 90 and 91. A surface 92 of element 62 is not planar and does not extend axially to surface 84 except for a short transition piece 94 which connects the element 62 to the strengthening rib 80 which is disposed perpendicular thereto. The surface 92 is curvaceous, having a generally "S" shaped silhouette for reasons hereinafter provided.

Figure 4:
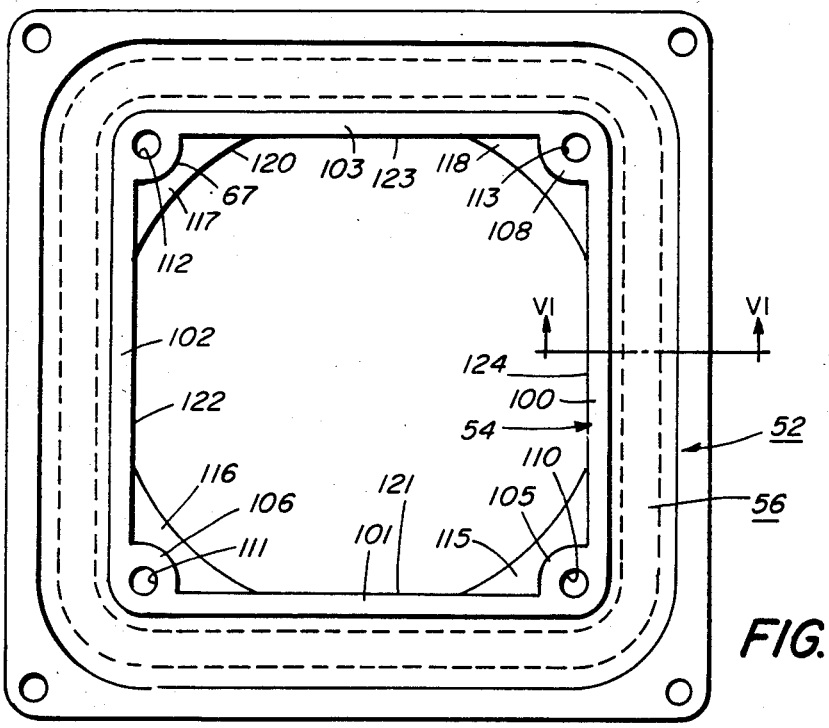
FIG. 4 is a bottom plan view of the vibration-isolating and sealing mount shown in FIG. 2.

The inner frame 54, as shown in FIGS. 2 and 4 comprises four integrally-molded elongate elements 100, 101, 102, 103 of equal length, each one connected orthogonally at its ends to another of the elements so as to form a square. Corners 105, 106, 107, 108 between abutting ends of elements 100–103 are each provided with holes 110, 111, 112, 113 and crescent flats 115, 116, 117, 118, respectively. Holes 110–113 are sized and spaced to receive therethrough bolts 45 which fasten the fan 10 to the device 50. For example, the holes 110–113 can be threaded so as to receive the bolts 45 in threaded engagement. As a representative example, crescent flat 118, corner 108 and hole 113 are shown in FIG. 5. The cross-sectional shape of elements 100–103 can be gleaned from FIG. 6. The element 101 is shown in cross-section as having a planar surface 119 substantially coplanar with surface 82, two depending side walls 120 and 122, and a surface 123 substantially coplanar with surface 84. The overall cross-sectional configuration is boot-like, with the radial extent or thickness of planar surface 123 being less than that of surface 119. Side wall 120 is disposed perpendicularly to both surfaces 123 and 119. Side wall 122 has a portion 125 which is parallel to side wall 120 and proximate to surface 119, and an arcuate portion 127 disposed between the portion 125 and surface 123.

Returning to FIG. 4, the crescent flats 115–118 are planar elements having an axial extent less than the elements 100–103, and a radial extent from the corners 105–108 inward a distance sufficient to provide a substantially circular opening 120 (albeit with flattened sides 121, 122, 123, 124 though such are not necessary). The diameter of the circular opening 120 should be approximately equal to the diameter of opening 32 in cylindrical body 30 of the fan housing 12 (FIG. 1). Thus the openings 120, 27, 29 and 32 (FIGS. 1 and 4) act as cylindrical guides or shrouds which direct the air flow to or away from the propeller 18 (FIG. 1). This effectively reduces turbulent air flow and the resultant noise, and loss of efficiency of the fan 10 (FIG. 1) associated with turbulent flow. The invention can be practiced with a variety of commercially available fans and blowers. The axial thickness and width of the membrane 56 (FIG. 5) and the shear and Young's moduli of elasticity characterizing the elastomer from which it is made can be selected and designed in manufacture so that the device 50 (FIG. 1) can support the required weight while achieving the desired vibrational isolation at the particular band-pass frequencies. The following is an example of performance and design for a typical application of the invention. A muffin fan of three inch diameter having seven blades and a weight of 0.86 lbs. may operate at speeds of 3,000 RPM (50 HZ). The device 50 constructed in accordance with the invention can be 4.6 inches square and 0.27 inches thick, with a natural frequency of 18 hertz, peak transmissibility of six to eight and an isolation efficiency (analyticly determined) of approximately 73% at 50 Hertz disturbance and approximately 99% at 350 Hz disturbance.

Though the housing 12 and mount 50 are shown in FIG. 1 as separately formed elements joined by bolts 45, it should be understood that the invention also contemplates their manufacture as an integral, one-piece unit, and thus not require bolts 45. Such a vibration isolating and sealing housing would effect economies in manufacture and assembly.

It will be apparent that the invention herein described is susceptible of being practiced otherwise than is herein illustrated. For example, the device 50 can be provided with two or more openings 120 so as to serve as a vibration isolating and sealing mount for two or more fans simultaneously. As a further example, the device 50 can be reconfigured into a circular or triangular form instead of the square as illustrated, if the application permits.

The embodiments of the invention to which an exclusive property or privilege is claimed are defined as follows:

1. A vibration isolating and sealing device for mounting a fan having a propeller rotatably secured within a housing, said device comprising: a first, substantially rigid frame; a second, substantially rigid frame; a flexural elastomeric membrane adapted and configured to vibrationally isolate between the first and second frames, disposed and bonded between said first and second frames and being the only structural connection therebetween; said second frame defining therein a central opening equal to or larger than the diameter of the propeller; and being adapted and configured to channel air to the propeller of the fan; and said housing being securable to and supportable by one of the frames and the other frame being securable to and supportable by one of the frames and the other frame being securable to a support surface; wherein the first and second frames are each of a generally square shape concentrically disposed relative to one another.

2. The device of claim 1 wherein the second frame is disposed radially inwardly of the first frame and is securable to the fan housing.

3. The device of claim 2 wherein the second frame is integral with the fan housing.

4. The device of claim 1 wherein the first and second frames contain elastomer.

5. The device of claim 2 wherein the first and second frames have boot-like cross-sections.

6. The device of claim 5 wherein the flexural element has a generally "S" shaped cross-section.

7. The device of claim 2 wherein the first and second frames each have confronting, generally axially-extending surfaces to which the membrane is bonded substantially along their entire lengths.

8. The device of claim 7 wherein the membrane is radially contained between the axially-extending surfaces.

9. The device of claim 2 wherein the first frame comprises a first pair of elongate elements disposed in spaced parallel relation relative to one another.

10. The device of claim 9 wherein the first frame further comprises a second pair of elongate elements disposed in spaced parallel relation relative to one another.

11. The device of claim 10 wherein the first pair of elements is connected at the ends of its elements to the ends of the elements of the second pair.

12. A vibration isolating and sealing device for mounting a fan having a propeller rotatably secured within a housing, said device comprising: a first, substantially rigid frame; a second, substantially rigid frame; a flexural elastomeric membrane adapted and configured to vibrationally isolate between the first and second frames, disposed and bonded between said first and second frames and being the only structural connection therebetween; said second frame defining therein a central opening equal to or larger than the diameter of the propeller; and being adapted and configured to channel air to the propeller of the fan; and said housing being securable to and supportable by one of the frames and the other frame being securable to and supportable by one of the frames and the other frame being securable to a support surface; wherein the second frame is disposed radially inwardly of the first frame and is securable to the fan housings; wherein the second frame includes a radially-extending inner surface and an axially-extending surface connected thereto, and wherein the membrane is bonded continuously to both said radially-extending inner surface and said axially-extending surface.

13. The device of claim 12 wherein the flexural element has a generally "S" shaped cross-section.

14. A vibration isolating and sealing device for mounting a fan having a propeller rotatably secured within a housing, said device comprising: a first, substantially rigid frame; a second, substantially rigid frame; a flexural elastomeric membrane adapted and configured to vibrationally isolate between the first and second frames, disposed and bonded between said first and second frames and being the only structural connection therebetween; said second frame defining therein a central opening equal to or larger than the diameter of the propeller; and being adapted and configured to channel air to the propeller of the fan; and said housing being securable to and supportable by one of the frames and the other frame being securable to and supportable by one of the frames and the other frame being securable to a support surface; wherein the second frame includes a radially-extending inner surface and an axially-extending surface connected thereto, and wherein the membrane is bonded continuously to both said radially-extending inner surface and said axially-extending surface wherein; the second frame is disposed radially inwardly of the first frame and is securable to the fan housing; wherein the first frame has a radially-extending inner surface and an axially-extending surface connected thereto, and wherein the membrane is bonded substantially continuously to both said radially-extending inner surface and said axially extending surface.

15. A vibration isolating and sealing device for mounting a fan having a propeller rotatably secured within a housing, said device comprising: a first, substantially rigid frame; a second, substantially rigid frame; a flexural elastomeric membrane adapted and configured to vibrationally isolate between the first and second frames, disposed and bonded between said first and second frames and being the only structural connection therebetween; said second frame defining therein a central opening equal to or larger than the diameter of the propeller; and being adapted and configured to channel air to the propeller of the fan; and said housing being securable to and supportable by one of the frames and the other frame being securable to and supportable by one of the frames and the other frame being securable to a support surface; wherein the second frame includes a radially-extending inner surface and an axially-extending surface connected thereto, and wherein the membrane is bonded continuously to both said radially-extending inner surface and said axially-extending surface wherein; the second frame is disposed radially inwardly of the first frame and is securable to the fan housing; wherein the second frame comprises a first pair of spaced, parallel, elongate elements; and a second pair of spaced, parallel, elongate elements connected to the first pair.

16. A mounting device for use with a muffin fan comprising a housing including a cage and a fan including a propeller having a plurality of radially-extending blades rotatable mounted on a hub and disposed within the cage, said mounting device includes:

(a) an outer, substantially rigid frame having a plurality of elongate elements, at least one pair of which being in parallel spaced relation, said outer frame including first mounting means;

(b) an inner, substantially rigid frame having four elongate elements each one orthogonally connected at each of its ends to an end of another of the elements, said inner frame including second mounting means:

(c) a flexural membrane of generally continuous shape disposed and bonded between said inner frame and said outer frame and being the only structural connection therebetween;

(d) wherein said cage is fastened to said inner frame by use of said second mounting means; and said outer frame is fastened to a surface on which the muffin fan is to be mounted by use of said first mounting means;

(e) whereby said connection between said cage and said mounting device and between said mounting device and said surface is such as to substantially prevent air passage therethrough when the muffin fan is in operation; and (f) whereby said mounting device is both a vibration isolator and seal, and supports the static and dynamic loads of the muffin fan while providing a path break for structure borne noise and vibration.

17. The device of claim 16 wherein the first and second mounting means comprise through holes defined in the respective frames and sized and configured to a fastener.

18. The device of claim 16 wherein the inner and outer frames are of generally square configuration.

19. A device comprising a housing including a cage portion and a mounting portion axially connected to said cage portion, a fan including a propeller having a plurality of radially extending blades rotatably mounted on a hub, and wherein the mounting portion includes:

(a) an outer, substantially rigid frame having four elongate elements of substantially equal length, each one orthogonally connected at each of its ends to an end of another of the elements so as to form a generally square shape, and four bulbous protrusions, one disposed between the ends of adjoining elements and having an axially directed hole therethrough, each of said elements having a curved inner surface;

(b) an inner, substantially rigid frame having four elongate elements of substantially equal length, each one orthogonally connected at each of its ends to an end of another of the elements so as to form a generally square shape; four bulbous protrusions, one disposed at each of the ends of adjoining elements and having an axially directed hole therethrough, and four crescent flats, one disposed at each of the ends of adjoining elements and having a curved inner surface configured so as to define a substantially circular opening within said inner frame having a diameter substantially equal to the outer diameter of the propeller, each of said elements having a curved outer surface;

(c) a flexural membrane of generally continuous square shape and a generally "S" shaped cross-section, wherein said flexural membrane has a curved radially outward surface and a curved radially inward surface, said membrane disposed between and connecting said inner frame to said outer frame, said membrane's outer curved surface being bonded to the inner curved surface of said outer frame and said membrane's inner curved surface being bonded to said outer curved surface of said inner frame;

(d) wherein said cage portion is bolted to one of said frames through said holes in said bulbous protrusions of said one of said frames; and said other of said frames is bolted to a substantially flat surface on which the fan is to be mounted through said holes in said bulbous protrusions of said other of said frames; and (e) wherein said connection between said cage portion and said mount portion and between said mount portion and said flat surface is such as to substantially prevent air passage therethrough when the fan is in operation;

(f) whereby said housing is both a vibration isolator and seal.

* * * * *